US009827652B2

(12) United States Patent
Mills

(10) Patent No.: US 9,827,652 B2
(45) Date of Patent: Nov. 28, 2017

(54) OPEN-END RATCHETING WRENCH

(71) Applicant: Neotech Manufacturing, LLC, Marshall, MO (US)

(72) Inventor: Douglas J. Mills, Harker Heights, TX (US)

(73) Assignee: Neotech ManuFacturing, LLC, Marshall, MO (US)

( * ) Notice: Subject to any disclaimer, the term of this patent is extended or adjusted under 35 U.S.C. 154(b) by 817 days.

(21) Appl. No.: 14/063,121

(22) Filed: Oct. 25, 2013

(65) Prior Publication Data

US 2015/0114185 A1 Apr. 30, 2015

(51) Int. Cl.

| | |
|---|---|
| ***B25B 13/12*** | (2006.01) |
| ***B25B 13/28*** | (2006.01) |
| ***B25B 13/46*** | (2006.01) |
| ***B25B 13/18*** | (2006.01) |
| ***B25B 13/32*** | (2006.01) |
| *B25B 13/08* | (2006.01) |

(52) U.S. Cl.

CPC ..... *B25B 13/46* (2013.01); *B25B 13/12* (2013.01); *B25B 13/18* (2013.01); *B25B 13/32* (2013.01); *B25B 13/08* (2013.01); *B25B 13/28* (2013.01)

(58) Field of Classification Search

CPC ..... B25B 13/08; B25B 13/12; B25B 13/18; B25B 13/32; B25B 13/46

See application file for complete search history.

(56) References Cited

U.S. PATENT DOCUMENTS

| | | | | |
|---|---|---|---|---|
| 2,655,064 A | | 10/1953 | Simon et al. | |
| 2,846,912 A | * | 8/1958 | Day | B25B 13/08 81/111 |
| 3,875,828 A | | 4/1975 | Evans | |
| 3,926,077 A | | 12/1975 | Nordgren | |
| 4,276,790 A | * | 7/1981 | Davis | B25B 13/46 81/62 |
| 4,324,159 A | | 4/1982 | Wrobbel | |
| 4,554,847 A | * | 11/1985 | DeSantis | B25B 13/46 81/111 |
| 4,718,315 A | | 1/1988 | Nitschmann | |
| 4,825,731 A | | 5/1989 | Stojanowski | |
| 5,018,412 A | | 5/1991 | Wylie, III | |
| 5,103,697 A | * | 4/1992 | Masbaum | B25B 13/24 81/148 |
| 5,282,830 A | | 2/1994 | Reynolds | |

(Continued)

OTHER PUBLICATIONS

International Search Report and Written Opinion for Application PCT/US14/62036 dated Oct. 23, 2014.

*Primary Examiner* — Bryan R Muller

(74) *Attorney, Agent, or Firm* — Tumey L.L.P.

(57) ABSTRACT

The present invention may be used for rotating a polygonal object. A first wrench member may have a handle with two ends with a fixed jaw attached at a first end and with a cavity formed in the fixed jaw and first end. A second wrench member may be a movable jaw with a curved jaw attached to a ratcheting element. The ratcheting element may be slidably positioned in the cavity to position the curved jaw opposite the fixed jaw. The second wrench member may be constrained by the cavity and a cavity insert member to slide in said cavity about the center of an arc. The cavity insert member is positioned between a rearward wall of the cavity and the ratcheting element and retains the ratcheting element within the cavity.

7 Claims, 5 Drawing Sheets

(56) References Cited

U.S. PATENT DOCUMENTS

| | | | | |
|---|---|---|---|---|
| 5,582,082 | A * | 12/1996 | Gajo | B25B 13/46 81/111 |
| 5,996,445 | A | 12/1999 | Wiens | |
| 6,339,978 | B1 | 1/2002 | Hirse | |
| 6,412,372 | B1 * | 7/2002 | Hsu | B25B 13/08 81/111 |
| 7,077,035 | B1 | 7/2006 | Huang | |
| 7,827,887 | B2 * | 11/2010 | Lee | B25B 13/08 81/179 |
| 7,886,636 | B1 * | 2/2011 | Mills | B25B 13/08 81/111 |
| 8,342,063 | B2 * | 1/2013 | Stanton | B25B 13/08 81/179 |
| 8,701,528 | B2 * | 4/2014 | Wu | B25B 13/08 181/126 |

* cited by examiner

OPEN-END RATCHETING WRENCH

BACKGROUND OF INVENTION

1. Field of the Invention

This invention relates to devices for rotating a polygonal fastener, such as a bolt head, nut or like. The new device has an open-end wrench structure with a movable jaw, ratchet control apparatus.

2. Description of Related Art

Fixed jaw, open-end wrenches known in the art may be limited in use for rotating polygonal fasteners because of a long swing or rotational movement requirement. For example, for a hexagonal headed bolt the wrench arm must be rotated 60 degrees to reposition the wrench on adjacent faces of the bolt head to continue to rotate the bolt. This may prevent use of the wrench in areas with limited space. Also, repositioning the wrench for each stroke may add time and effort to manipulating the fastener. Closed-ring configured wrenches allow smaller swing angles, but may still have to be repositioned, or if a socket-type ratchet, may not be used on hydraulic lines, fuel lines, fasteners with long shafts and the like due to vertical clearance requirements.

There may be various devices and inventions know that have been developed in attempts to produce a strong, compact open-end ratcheting wrench. The general approaches for such devices may include: a wrench with fixed jaws that have a special shape that applies torque in one direction and slips around the fastener in an opposite direction; a wrench with both jaws integral with the handle, having small pawls, rollers or camming components carried around their internal surfaces to allow gripping movement of a fastener in only one direction; and open-end wrenches with one or both jaws unidirectionally relieving to allow ratcheting. The first type of mechanism only allows large rotational or swing angle use, that is, for a hexagonal bolt head the swing angle would be 60 degrees. The second type of wrench may be inherently fragile and complicated to manufacture and assemble.

A third type of open-end ratcheting wrenches, those that use a relieving jaw, may have failed to achieve both adequate strength and a compact profile. Several designs may utilize a movable jaw that may be slideably positioned over a wrench head with an attached fixed jaw and may be fastened by a pin to allow rotation of the movable jaw. This may result in a weak mechanism with a bulky head. Another design that has a movable jaw slideably positioned over a wrench head or handle with curved surfaces for engagement when torqueing a fastener is also fastened by a pin positioned in a slot. This design appears to also result in a weak mechanism resulting in breakage of the jaw mechanism as experienced by users.

U.S. Pat. No. 7,886,631 discloses an open-end ratcheting wrench that includes a first wrench member having a cavity and a second wrench member with a ratcheting element positioned within the cavity. An insert is positioned between a forward face of the ratcheting element and a forward portion of the first wrench member. The invention disclosed herein represents an improvement over the wrench disclosed therein in that it provides a more durable structure. In order to accommodate the cavity insert, it was necessary to form a depression in the front portion of the ratcheting member which greatly weakened the area. By positioning the cavity insert between a rearward wall of the cavity and a bearing surface on the rear portion of the ratcheting member, the depression is no longer required and thus the ratcheting element is significantly strengthened. The cavity insert functions as a retaining member for the ratcheting element, provides a bearing surface for the ratcheting element and includes a spring seat for the elastic element.

BRIEF SUMMARY OF THE INVENTION

The present invention is directed to devices for rotating a polygonal object. A first wrench member may have a handle with two ends with a fixed jaw attached at a first end and with a cavity formed in the fixed jaw and first end. A second wrench member may be a movable jaw with a curved jaw attached to a ratcheting element. The ratcheting element may be slideably positioned in the cavity to position the curved jaw opposite the fixed jaw. The second wrench member may be constrained by the cavity and a cavity insert member to slide in said cavity about the center of an arc. The second wrench member may be spring biased by an elastic compression element to move toward the fixed jaw. A gripping surface of the curved jaw may be structured relative to the center of the arc to cause the curved jaw to be urged toward the fixed jaw when the handle may be moved in a direction to urge the fixed jaw toward the curved jaw when a polygonal object is between the two jaws.

These and other features, aspects and advantages of the present invention will become better understood with reference to the following drawings, description and claims.

BRIEF DESCRIPTION OF THE SEVERAL VIEWS OF THE DRAWING(S)

DETAILED DESCRIPTION OF THE INVENTION

The following detailed description represents the best currently contemplated modes for carrying out the invention.

The description is not to be taken in a limiting sense, but is made merely for the purpose of illustrating the general principles of the invention.

Figure 1:
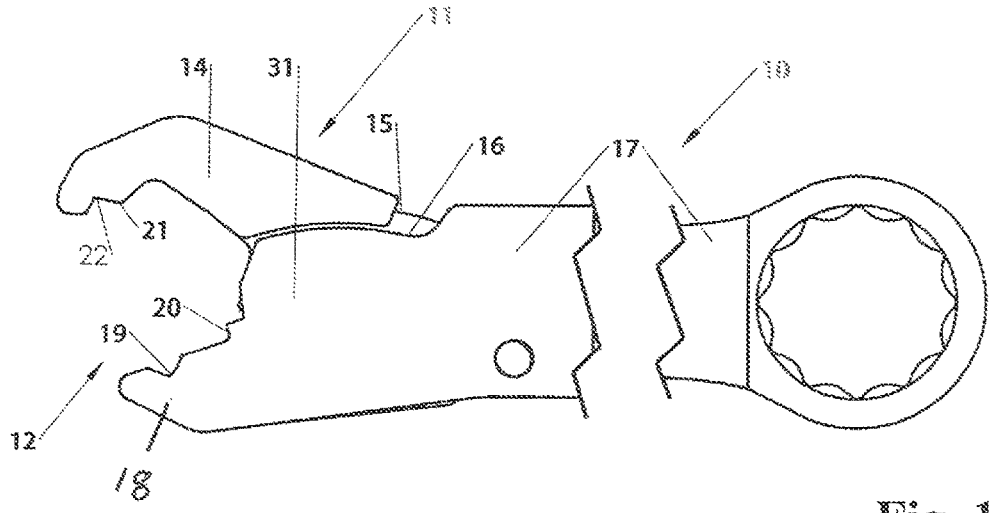
FIG. 1 illustrates a side view of a wrench according to an embodiment of the invention.
Figure 2:
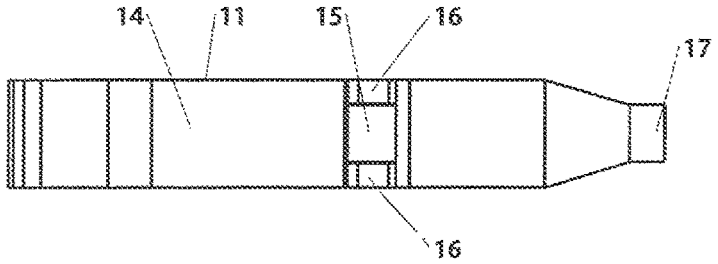
FIG. 2 illustrates a top view of one end of a wrench according to an embodiment of the invention.
Figure 3:
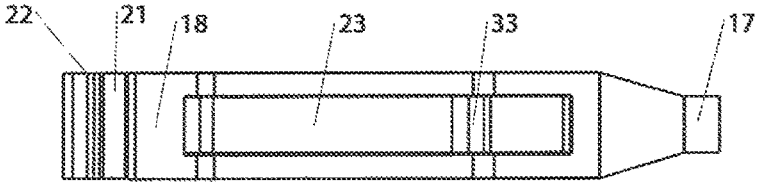
FIG. 3 illustrates a bottom view of one end of a wrench according to an embodiment of the invention.
Figure 4:
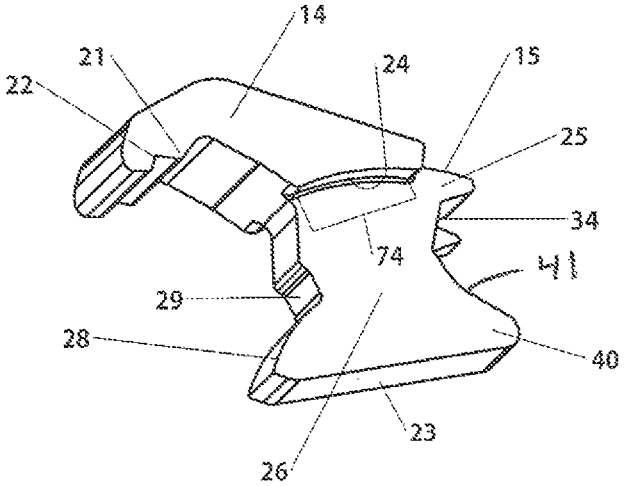
FIG. 4 illustrates a perspective view of a movable jaw according to an embodiment of the invention.
Figure 5:
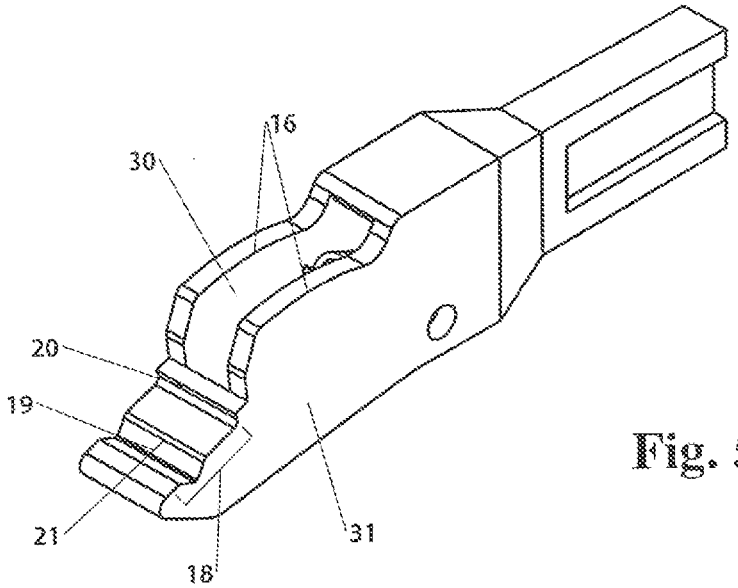
FIG. 5 illustrates a perspective view of a fixed jaw and partial handle with the cavity insert member and ratcheting member removed according to an embodiment of the invention.
Figure 6:
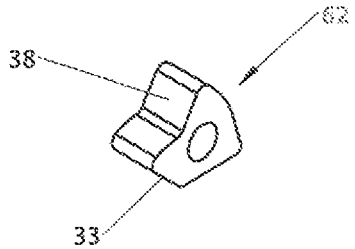
FIG. 6 illustrates a perspective view of a cavity insert member according to an embodiment of the invention.

Referring to FIGS. 1 through 2, a wrench 10 may have a handle 17 with a ratcheting member 12 at one end. The ratcheting member 12 may have fixed jaw 18 attached to the handle 17 and an opposed movable jaw 11 that may be slidably engaged in a cavity 39 formed in the fixed jaw 18 and handle 17 and an opposed movable jaw 11 that may be slidably engaged in a cavity 39 formed in the fixed jaw 18 and handle 17. For purpose of descriptive directional orientation only, the upper portion and lower portion of the wrench 10 as viewed in the figures, such as FIG. 1, may be referred to as the top and the bottom respectively.

Figure 10:
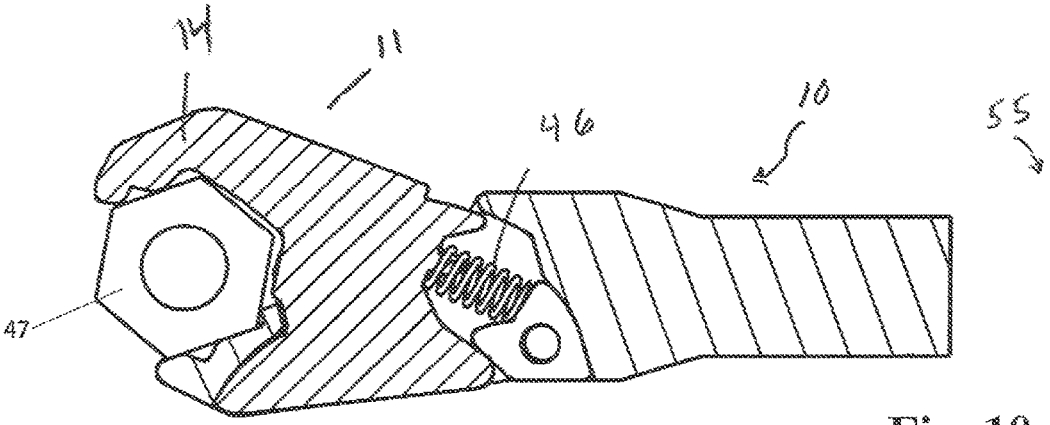
FIG. 10 illustrates a cross-sectional view of a ratcheting member and partial handle, assembled, with the cavity insert member in place, spring in place, and a polygonal object between the jaws in the first loaded position according to an embodiment of the invention.
Figure 11:
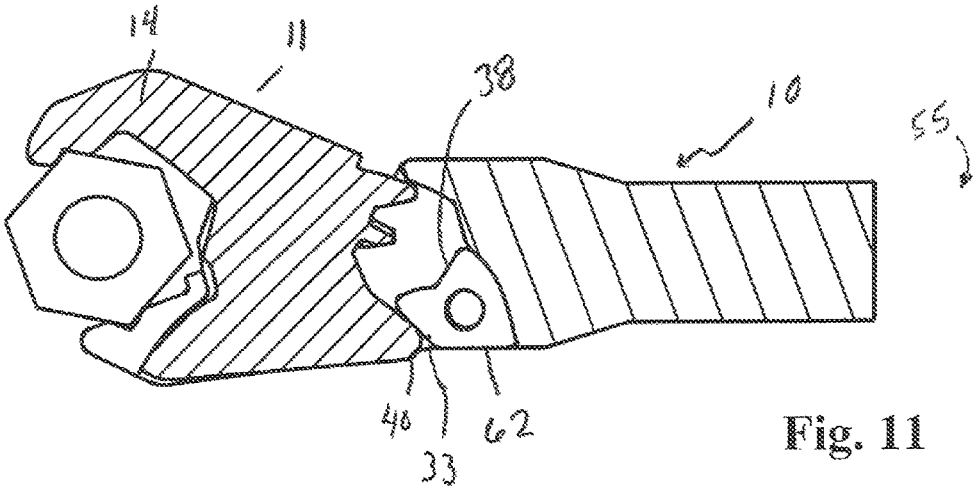
FIG. 11 illustrates a cross-sectional view of a ratcheting member with a polygonal object between the jaws in the second loaded position according to an embodiment of the invention.
Figure 12:
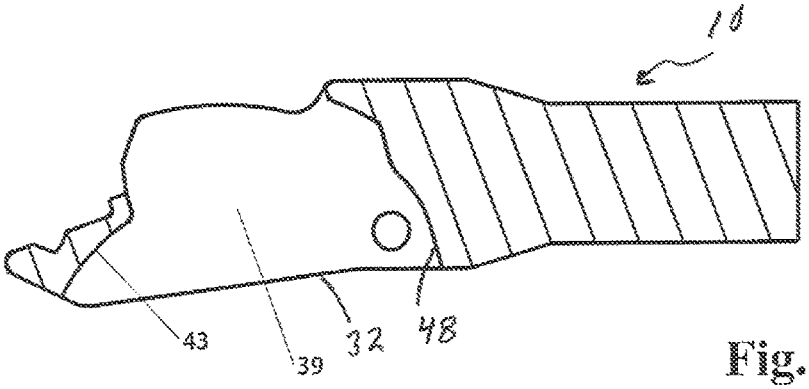
FIG. 12 illustrates a cross-sectional view of a fixed jaw and partial handle with the ratcheting member and cavity insert member removed according to an embodiment of the invention.
Figure 13:
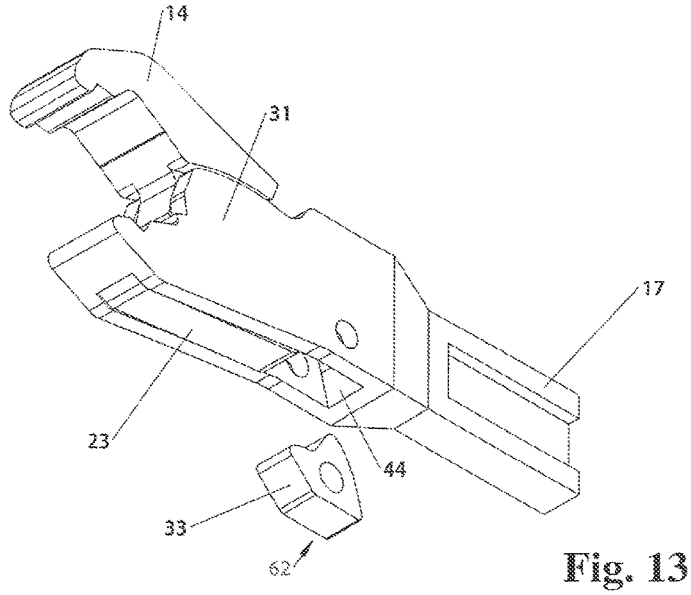
FIG. 13 illustrates a perspective view of a ratcheting member, fixed jaw and partial handle with the cavity insert member removed according to an embodiment of the invention.
Figure 14:
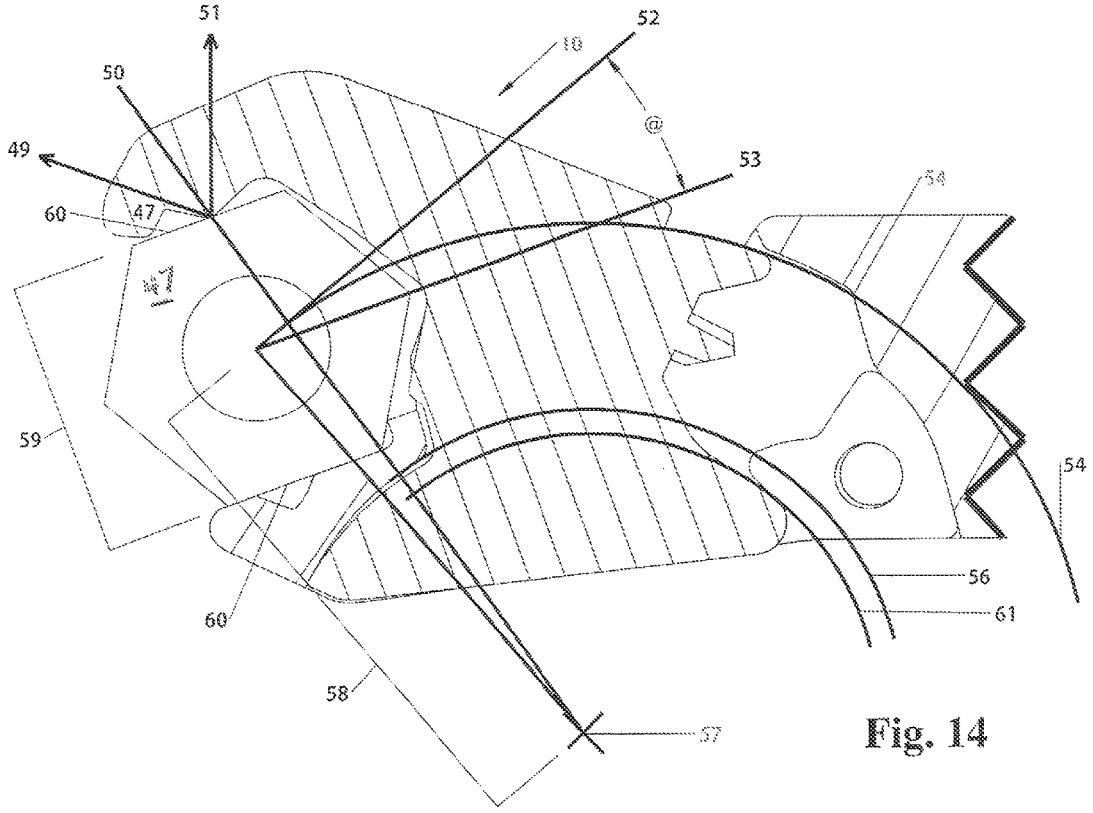
FIG. 14 illustrates a cross-sectional view of a ratcheting member with a polygonal object between the jaws and the geometry related to the rotational sliding movement of the movable jaw relative to a center of rotation according to an embodiment of the invention.

The cavity 39 may be formed of two opposed sidewalls 31, a forward wall 42 with an exterior gripping surface 45 and an interior concave bearing surface 43, and a rearward wall 48 spaced apart from the forward wall 42 to form an opening 32 there between, and a top wall portion 37 of the cavity 39 with a concave surface 36 spaced apart from a vertical projection 20 of the forward wall 42 to form a slot 30 there between. The movable jaw 11 may be spring biased toward the forward wall 42 by a spring 46 as shown in FIG. 10. The movable jaw 11 may be an irregularly shaped structure with a thicker curved jaw arm 14 attached to a thinner ratcheting element 26. The ratcheting element 26 in the assembled position is sandwiched between the walls 31 of the cavity 39 and may have an irregularly shaped rearward edge 41 with an elongated top horizontal projection 25 for acting as the roof of a spring seat 34. The spring seat 34 is to be positioned relatively opposite the spring seat 38 of the cavity insert member 62. A top edge 15 of the projection 25 may have a convex surface shaped to accommodate the concave surface 36 of the tope aspect of the rearward wall 37. A generally rounded projection 40 located on the bottom aspect of the rearward edge 41 of the ratcheting element 26 acts as a bearing surface that abuts the bearing surface 33 of the cavity insert member 62 as shown in FIG. 11. A forward edge of the ratcheting element 26 may have a convex bearing surface 28 shaped to abut the concave bearing surface 43 located on the inside aspect of the forward wall 42. The ratcheting element 26 may have a bottom edge 23 located between the rearward edge 41 and the forward edge 28, and a surface 29 that abuts the vertical inside surface 20 of the forward wall 42. The curved jaw 14 may be thicker than the ratcheting element 26 which may create a ridge surface 24 at the attached portion 74 which ridge surface 24 may abut the top side edges 16 of the side walls 31 to aid in controlling the rotational motion of the ratcheting element 26.

The various edges and attachment portion 74 define the shape of the ratcheting element 26 that may generally be a flat plate structure that may be slideably positioned in the cavity 39 with the bottom edge 23 adjacent the opening 32 and the top edge 15 of the horizontal projection of the rearward edge 41 of the ratcheting element 26 abutting the concave surface 36 during the ratcheting movement. The curved jaw 14 is generally positioned opposed to the fixed jaw 18 when the ratcheting element 26 is positioned in the cavity 39. When positioning the ratcheting element 26 in the cavity 39 a spring 46 may be positioned between the spring seat 34 and the spring seat 38 to bias the ratcheting element 26 toward forward wall 42. A cavity insert member 62 may be inserted in the slot 44 and retained in position, for example, by an epoxy material, rivet, or other attachment method. The cavity insert member 62 may serve to retain the ratcheting element 26 in the cavity 39, may also act as a spring seat 38, and may act as a bearing surface 33.

Figure 7:
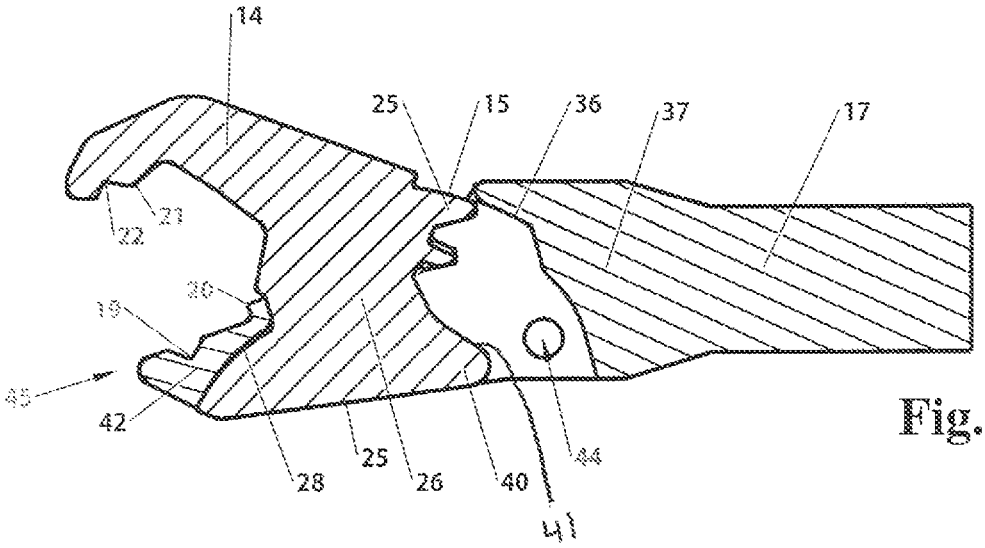
FIG. 7 illustrates a cross-sectional view of a partial handle and ratcheting member in the fully forward position according to an embodiment of the invention.
Figure 8:
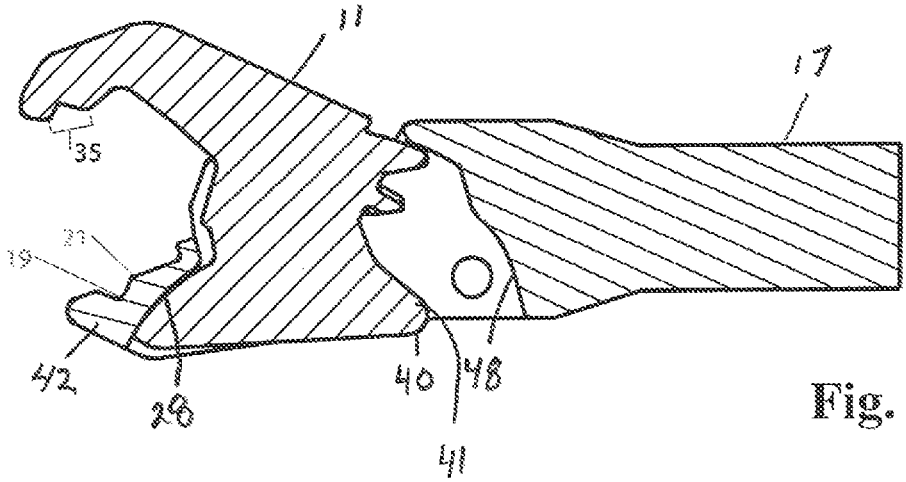
FIG. 8 illustrates a cross-sectional view of a partial handle and ratcheting member in a partially ratcheted position according to an embodiment of the invention.
Figure 9:
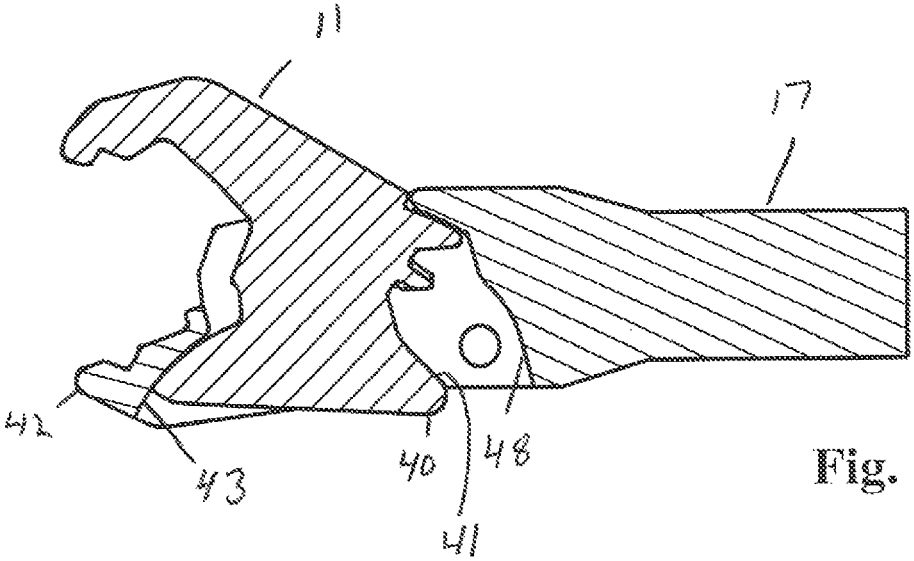
FIG. 9 illustrates a cross-sectional view of a partial handle and ratcheting member in the fully ratcheted position according to an embodiment of the invention.

With the ratcheting element 26 installed in the cavity 39, the fixed jaw 18 with exterior gripping surface 45 that may have at least one notch 19 and boss 21 may be positioned opposed to the gripping surface 35 of the movable jaw 11 that may have at least one notch 22 and boss 21, as shown in FIGS. 7, 8 and 9.

Referring to FIGS. 10 through 14, for efficiency of operation of the wrench 10 for gripping hexagonal fasteners and ratcheting around them, the structure for a wrench 10 to manipulate a bolt head, nut or the like fastener 47 that has a hexagonal shape is described. The center 57 of circles or concentric arcs 54, 56, 61 may be used to define the shape of the surfaces and edges that abut to support force and ratcheting relative to a hexagonal object such as a nut 47. A first arc 54 of radius 58 may be defined as approximately the length of twice the distance 59 between opposite faces 60 of the nut 47 to be manipulated. The arc 54 should pass through the center of the nut 47. To define a third parameter to locate the center 57, a line 53 passing through the nut 47 center parallel to the opposing nut faces 60 serves as a reference for angular positioning of a tangent line 52 to arc 54 whose normal line 50 passes through the contact point 51 on movable jaw 11. The tangent line 52 should be positioned at an acute angle @ of approximately 15 degrees plus or minus 5 degrees relative to the line 53. With these three parameters the arc center 57 may be located. While the arcs 54, 56 have been described as concentric, the center for each are 54, 56 may be separated in distance plus or minus one inch.

When rotating the wrench 10 to move the fixed jaw 18 toward the curved jaw 14 the spring biased curved jaw 14 may engage a nut 47 at one of the gripping positions as illustrated in FIGS. 10 and 11. As force is applied in the direction of arrow 55, the relatively fixed nut 47 may exert an equal and opposite reaction force at the contact point 51 represented by the direction of arrow 49. Since the angular direction of the reaction force 49 produced by the nut 47 acting on the movable jaw 11 is greater in the direction for closing than the normal line 50 from the center 57 of the arc 54 defining the arc traveled by the movable jaw 11, it results in the tendency of the movable jaw 11 to rotate in the direction of the arrow 49, thereby urging the movable and fixed jaws 11, 18 closer together to clamp the nut 47, while simultaneously rotating the nut. The wrench 10 may be used to move the nut 47 rotationally in either direction by simply rotating the wrench 10 on its longitudinal axis 180 degrees.

To allow the ratcheting member 12 to slip or ratchet around the nut 47 the wrench 10 may be rotated in the direction opposite the gripping direction 55, that is, to rotate the wrench 10 to move the fixed jaw 18 away from the curved jaw 14. The direction of the reaction force 51 then moves to the opposite side of the normal line 50, forcing the movable jaw 11 to rotate in the direction opposite the gripping direction thereby compressing the bias spring 46 and allowing the movable jaw 11 to relieve away from the fixed jaw 18 to slide over the corners of the nut 47.

The arc 56 and a concentric arc 61 defines the curves of the bearing surfaces that abut between the cavity 39 and movable jaw 11. The concave bearing surface 43 that abuts the forward edge 28 has a surface along arc 56. The bearing surface 40 that abuts the wedge bearing surface 33 generally operates along arc 61. These bearing surfaces transfer the force 55 applied to the handle 17 to urge the fixed jaw 18 and curved jaw 14 toward one another and to rotate the fastener. These surface structures allow a simple rotational motion along the curve of the bearing arcs 56, 61 without the need for a pin or other structural member to control the rotation and force transference. This may allow for a more durable wrench and for ease of manufacture.

Referring to FIG. 1, the wrench 10 may have a fixed member 13, for example, a box wrench element, attached to the handle 17 end opposite the ratcheting member 12.

The members attached to the ends of the handle may incorporate mechanism that allow them to rotationally flex from side to side. This would be particularly advantageous for the open end ratchet as it would allow multiple angles of attack on the fastener.

While the invention has been particularly shown and described with respect to the illustrated embodiments thereof, it will be understood by those skilled in the art that the foregoing and other changes in form and details may be made therein without departing from the spirit and scope of the invention.

I claim:

1. A wrench for rotating a hexagonal object comprising:

a first wrench member comprising a handle having a first end and a second end with a fixed jaw attached at said first end and a cavity formed in said fixed jaw and said first end, said fixed jaw having an exterior gripping surface and said cavity is formed by two opposed spaced apart side walls of said fixed jaw, a forward wall adjacent the exterior gripping surface and forming a first interior concave bearing surface and a rearward wall having a bottom wall portion spaced apart from said forward wall to define an opening of the cavity therebetween;

a second wrench member comprising a movable jaw with a curved jaw attached to an element wherein said element is slideably disposed in said cavity to position said curved jaw opposed to said fixed jaw; said second wrench member retained within the cavity by a plurality of bearing surfaces on said element disposed in said cavity and a wedge shaped cavity insert member fastened in said cavity, said curved jaw biased by an elastic compression element to move toward said fixed jaw; and a first gripping surface of said curved jaw having a notch therein, said curved jaw urged toward said fixed jaw when said handle is moved in a gripping direction about a polygonal object that is fixed or connected with resistance to motion relative to another object and is placed between and in contact with said fixed jaw and said curved jaw, said cavity insert member being positioned between the rearward wall of said cavity and the second wrench member, said fixed jaw also including a notch therein.

2. The wrench as claimed in claim 1 wherein said cavity is further defined by a top wall portion of said rearward wall spaced apart from a forward wall projection to define a slot therebetween and said top wall portion of said rearward wall having a second interior concave surface; and said rearward wall having a bottom surface to accommodate the cavity insert member.

3. The wrench as claimed in claim 2 wherein said element comprises:

a generally flat irregularly shaped plate with a generally horizontal elongated top rearward edge having a first convex top surface shaped to operate along said second interior concave surface of the cavity top rearward wall;

a rearward middle bend portion having an elastic member seat therein;

a rearward bottom projection with a curved bearing surface to abut a bearing surface of said cavity insert, and a forward edge with a bottom projection having a second convex bearing surface shaped to abut said first interior concave bearing surface of the bottom frontward wall of the cavity; and a forward top surface to act as a stop against the vertical aspect of the top frontward wall of the said cavity as the element is urged forward by the said elastic member.

4. The wrench as claimed in claim 1 wherein said fixed jaw has a gripping surface with the one notch formed therein.

5. The wrench as claimed in claim 4 wherein said first griping surface has at least one boss formed thereon.

6. The device as claimed in claim 1 wherein said elastic compression element is a spring.

7. The device as claimed in claim 2 wherein said cavity insert is fastened in a slot formed by bottom rearward aspects of the said sidewalls, and the bottom aspect of the rearward wall, said cavity insert acting as a retaining member for the element, a bearing surface for the element, and a spring seat for the elastic element.

* * * * *